US005514019A

United States Patent [19]

Smith

[11] Patent Number: 5,514,019

[45] Date of Patent: May 7, 1996

[54] LIFE JACKET WITH STABILIZING HANDLES

[76] Inventor: Dana R. Smith, 920 Ponderosa, Page, Ariz. 86040

[21] Appl. No.: 296,505

[22] Filed: Aug. 26, 1994

[51] Int. Cl.[6] ..... B63C 9/08

[52] U.S. Cl. ..... 441/88; 2/311

[58] Field of Search ..... 280/290, 801.1; 224/247, 257, 250, 264; 16/110 R:116 R, 114 R, 114 B, 125; 190/115, 116; 294/31.2, 153, 170; 114/270; 441/108, 111–119, 80, 88, 125, 129; 2/311, 321

[56] References Cited

U.S. PATENT DOCUMENTS

| | | | |
|---|---|---|---|
| 3,449,778 | 6/1969 | Jones | 441/112 |
| 4,429,419 | 2/1984 | Snyder | 2/311 |
| 4,551,107 | 11/1985 | Scheurer et al. | 441/112 |
| 4,556,245 | 12/1985 | Gruenwald | 16/116 R |
| 4,863,409 | 9/1989 | Johnson et al. | 441/80 |
| 5,152,013 | 10/1992 | Johnson | 2/311 |
| 5,360,360 | 11/1994 | Peterson | 441/130 |
| 5,361,418 | 11/1994 | Luzenske | 441/80 |

*Primary Examiner*—Edwin L. Swinehart
*Attorney, Agent, or Firm*—Harry M. Weiss; Jeffrey D. Moy; Harry M. Weiss & Associates

[57] ABSTRACT

A handle for stabilizing a passenger riding in tandem with an operator of a vehicle has a tubular core made of soft rubber. The tubular core is surrounded by a pliable covering of foamed elastomeric material. A nylon strap extends through, and has an end portion projecting to either side of, the tubular core. The end portions of the strap are provided with snaps which allow the handle to be releasably connected to one or more belts worn by the operator of the vehicle.

10 Claims, 1 Drawing Sheet

LIFE JACKET WITH STABILIZING HANDLES

FIELD OF THE INVENTION

The invention relates to a device for stabilizing a passenger riding in tandem with an operator of a vehicle.

BACKGROUND OF THE INVENTION

When a passenger rides on a vehicle such as a jet ski in tandem with an operator of the vehicle, the passenger must stabilize him- or herself in some fashion. This can be accomplished by the passenger wrapping his or her arms around the operator. However, the resulting embrace is uncomfortable and greatly restricts the freedom of the operator. Accordingly, alternative proposals have been presented.

U.S. Pat. No. 3,564,616 shows a belt to be worn by an operator of a motorcycle, toboggan, snowmobile or the like. A fabric or leather strap is stitched to the belt and forms a pair of loops which can be grasped by a passenger.

U.S. Pat. No. 3,840,902 likewise illustrates a belt for the operator of a motorcycle. The passenger holds onto two rigid handles which are permanently secured to the belt.

U.S. Pat. No. 4,411,222 discloses a pair of grip devices which are attached to a belt. Each of the grip devices is molded as a single unit from plastic and includes a rectangular plate provided with a handle.

U.S. Pat. No. 4,429,419 teaches a motorcycle vest. Two leather or nylon straps to be grasped by a passenger are fixed to the vest.

U.S. Pat. No. 4,625,334 shows a harness for use by the operator of a motorcycle or ATV. A passenger can hold onto either of two pairs of straps which are mounted on the harness at different distances from the front center thereof.

U.S. Pat. No. 5,081,719 describes a safety belt for a motorcycle. The belt is designed to carry a pair of handle members each of which consists of a planar support, and a U-shaped handle to be gripped by a passenger.

None of the above devices can be comfortably grasped by a passenger for an extended length of time. This problem is overcome, at least to some extent, by U.S. Pat. No. 5,152,013 which discloses a belt provided with a pair of foamed elastomeric or rubbery spool-shaped handles. The belt carries two anchors and the handles are mounted on the belt by way of endless nylon straps which pass through the handles and through slots in the anchors.

The handles and straps of the U.S. Pat. No. 5,152,013 are shown as being permanently fixed to the belt. Thus, the straps and handles can be used only with the belt on which they are mounted.

SUMMARY OF THE INVENTION

It is an object of the invention to provide a stabilizing handle which can be transferred from one article to another.

Another object of the invention is to provide a relatively comfortable stabilizing handle.

An additional object of the invention is to provide a method of making a stabilizing handle which is transferable from one article to another.

A further object of the invention to provide a stabilizing handle which is relatively comfortable to grasp.

The preceding objects, as well as others which will become apparent as the description proceeds, are achieved by the invention.

One aspect of the invention resides in a handle for stabilizing a passenger riding in tandem with an operator of a vehicle. The handle comprises, in combination, a tubular gripping member having two ends, and a pliable covering surrounding the gripping member. The handle further comprises an anchoring member extending through the tubular member and having a first end portion outward of one end of the tubular member and a second end portion outward of the other end of the tubular member. Means is provided at each end portion of the anchoring member for releasably attaching the respective end portion to an article wearable by the operator of the vehicle.

Since the handle of the invention can be releasably attached to an article, the handle is quite versatile. For instance, a user of the handle can disconnect the handle at the end of a trip and carry the handle with him or her for use at a different time and/or place. Moreover, the handle is relatively comfortable to grasp due to the pliable covering which surrounds the gripping member.

Another aspect of the invention resides in a method of making a device for stabilizing a passenger riding in tandem with an operator of a vehicle. The method comprises the steps of forming a tubular gripping member having two ends, and applying a pliable covering to the gripping member. The method additionally comprises the step of locating an anchoring member having first and second end portions in the gripping member so that the first end portion of the anchoring member is disposed outward of one end of the gripping member and the second end portion of the anchoring member is disposed outward of the other end of the gripping member. The first and second end portions are maintained free of permanent engagement with one another.

The locating step may include the establishment of frictional engagement between the anchoring member and the tubular gripping member.

The method can further comprise the step of releasably connecting the anchoring member to an article wearable by the operator of the vehicle.

BRIEF DESCRIPTION OF THE DRAWINGS

Additional features and advantages of the invention will become apparent from the following description of preferred embodiments when read in conjunction with the accompanying drawings.

DESCRIPTION OF PREFERRED EMBODIMENTS

Figure 1:
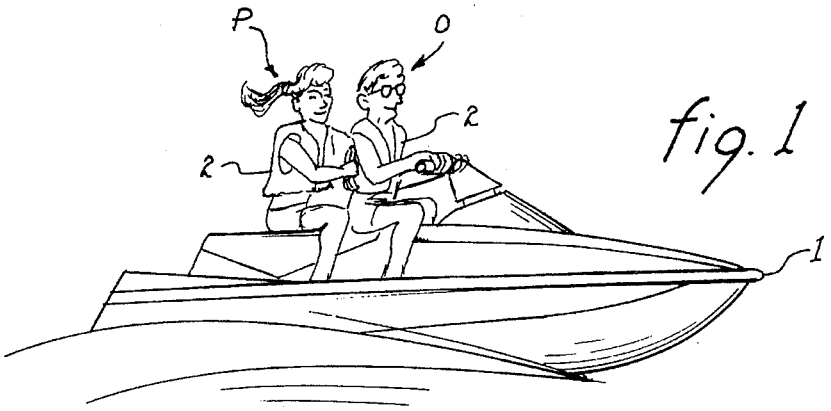
FIG. 1 is a perspective view of an operator and a passenger riding in tandem on a ski jet.

FIG. 1 shows a ski jet 1 which is being driven through the water by an operator O. A passenger P rides in tandem with the operator O, and both the passenger P and the operator O are wearing a conventional life jacket 2 illustrated in FIGS. 2, 5 and 6. The life jacket 2 has four adjustable belts 3 for securing the life jacket 2 to a wearer. Each of the belts 3 is provided with a buckle 4 and a catch 5 for releasably connecting the ends of the respective belt 3 to one another. The three lowermost belts 3 are guided in loops 6 defined by strips of material 7 extending generally perpendicular to the belts 3.

The life jacket 2 worn by the operator O carries a pair of handles 8*a* and 8*b* each of which is connected to two of the belts 3. The handles 8*a*,8*b* are designed to be gripped by the passenger P in order to stabilize the passenger P on the ski jet 1.

Figure 4:
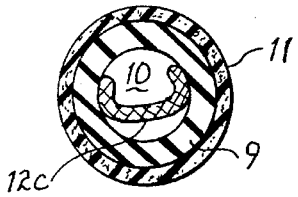
FIG. 4 is a sectional view as seen in the direction of the arrows IV—IV of FIG. 3.
Figure 3:
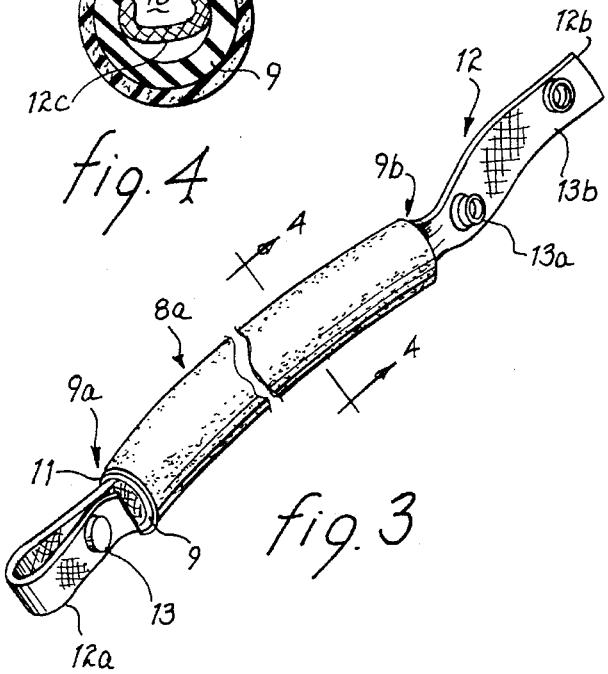
FIG. 3 is a perspective view of one of the stabilizing handles.

The structure of the handle 8*a*, which is similar to that of the handle 8*b*, is illustrated in FIGS. 3 and 4. The handle 8*a* includes a tubular core or gripping member 9 having opposite ends 9*a* and 9*b*. The tubular core 9 is generally cylindrical and is provided with a longitudinal central passage 10 of generally circular cross section. A generally cylindrical covering or layer 11 surrounds the tubular core 9 and is coextensive therewith longitudinally of the tubular core 9.

The covering 11 is preferably pliable or flexible so that the passenger P can grasp the handle 8*a* without hurting his or her hands. The tubular core 9 is advantageously resilient in order to permit bending of the composite or unit 9,11, i.e., the composite or unit made up of the tubular core 9 and the covering 11, from the unstressed condition of FIG. 3 to the flexed condition of FIG. 2. The ability of the unit 9,11 to bend increases the versatility of the handle 8*a* and makes it easier for the passenger P to hold onto the handle 8*a* for extended periods of time.

By way of example, the covering 11 can consist of a foamed elastomeric material while the tubular core 9 can be composed of soft rubber. It is preferred for the materials of the tubular core 9 and the covering 11 to be selected in such a manner that the unit 9,11 is capable of floating. This makes it possible to retrieve the handle 8*a* should it fall into the water.

The covering 11 can be vulcanized or adhesively bonded to the tubular core 9. However, if the covering 11 is a friction fit on the tubular core 9, it becomes a particularly simple matter to replace either one of the tubular core 9 or the covering 11 without damaging the other should the tubular core 9 or the covering 11 become worn or cracked.

The handle 8*a* further includes a strap or anchoring member 12 which extends through the central passage 10 of the tubular core 9. The strap 12 has a first end portion 12*a* outward of the end 9*a* of the tubular core 9, a second end portion 12*b* outward of the end 9*b* of the tubular core 9 and a median portion 12*c* in the central passage 10. The width of the median portion 12*c* of the strap 12 is preferably greater than the diameter of the central passage 10 as shown in FIG. 4 so that the strap 12 frictionally contacts the inner surface of the tubular core 9. This prevents the strap 12 from sliding out of and becoming separated from the unit 9,11. The strap 12 is made of a strong material such as nylon.

Each of the end portions 12*a*,12*b* of the strap 12 is provided with a snap 13 having a male portion 13*a* and a female portion 13*b*. The snaps 13 allow the handle 8*a* to be releasably connected to the belts 3 of the life jacket 2. This makes it possible to disengage the handle 8*a* from the life jacket 2 when the handle 8*a* is not needed and for the handle 8*a* to be carried around for use elsewhere.

The strap 12 can be removed from the passage 10 of the tubular core 9 by sliding the tubular core 9 and the strap 12 relative to one another longitudinally of the tubular core 9. Accordingly, it is not necessary to discard the entire handle 8*a* if one of its components 9, 11 or 12 becomes worn or cracked.

The handle 8*a* can be provided with more than one strap 12. The presence of plural straps 12 enables the safety of the handle 8*a* to be increased since the failure of one snap 13 or one strap 12 then does not result in disengagement of the handle 8*a* from the life jacket 2.

Figure 2:
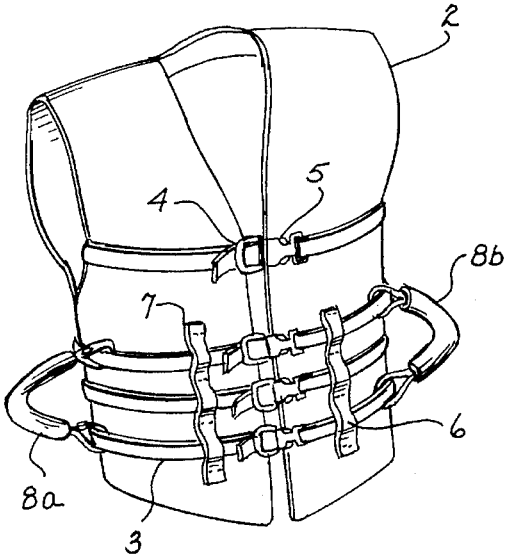
FIG. 2 is a perspective view of a life jacket worn by the operator and passenger of the ski jet and shows stabilizing handles in accordance with the invention mounted on the life jacket in a first position.
Figure 6:
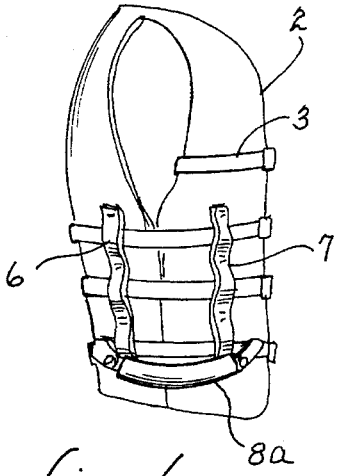
FIG. 6 is a rear view of the life jacket showing one of the stabilizing handles in a third position.
Figure 5:
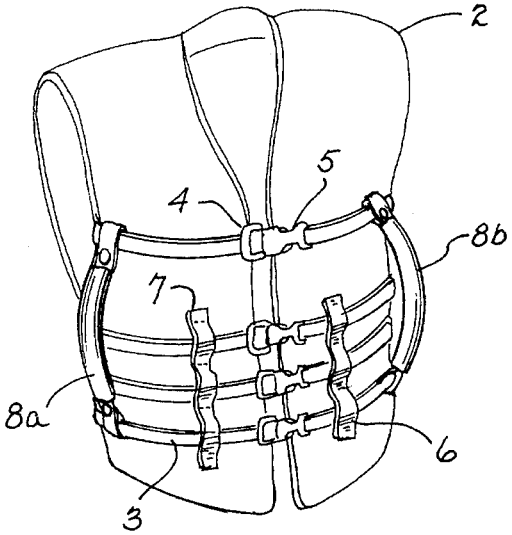
FIG. 5 is a perspective view of the life jacket illustrating the stabilizing handles in a second position.

In FIG. 2, the handles 8*a*,8*b* engage the lowermost and third-from-bottom belts 3 of the life jacket 2. However, there are many other options for mounting of the handles 8*a*,8*b* on the life jacket 2. Two such options are shown in FIGS. 5 and 6 by way of example. Thus, FIG. 5 illustrates the handles 8*a*,8*b* as being connected to the uppermost and lowermost belts 3. In FIG. 6, on the other hand, the handle 8*a* engages the lowermost belt 3 alone.

To make the handle 8*a* or 8*b*, the tubular core 9 and strap 12 are produced by conventional manufacturing techniques. If the covering 11 is to consist of a foamed elastomeric material, the covering 11 can then be foamed onto the tubular core 9 in a manner known per se. Alternatively, the covering 11 can be formed separately from the tubular core 9 using known production methods and subsequently applied to the tubular core 9.

The strap 12 is inserted in the tubular core 9 either before or after application of the covering 11 to the tubular core 9. Insertion of the strap 12 in the tubular core 9 is accomplished by moving the strap 12 and the tubular core 9 relative to one another longitudinally of the tubular core 9. The strap 12 is positioned so that the end portion 12*a* of the strap 12 is located outward of the end 9*a* of the tubular core 9 and the end portion 12*b* of the strap 12 is located outward of the end 9*b* of the tubular core 9.

Once the covering 11 has been applied to, and the strap 12 is properly situated in, the tubular core 9, the resulting handle 8*a* or 8*b* is snapped onto the life jacket 2.

Various modifications are possible within the meaning and range of equivalence of the appended claims. For instance, the use of the handles 8*a*,8*b* is not restricted to life jackets and the handles 8*a*,8*b* may find application on motorcycles, snowmobiles and similar vehicles. Moreover, the snaps 11 can be replaced by other releasable fastening means.

I claim:

1. A handle for stabilizing a passenger riding in tandem with an operator of a vehicle comprising in combination a flexible tubular gripping member made of soft rubber having two ends; a pliable covering surrounding said tubular gripping member; an anchoring member extending through said tubular gripping member and having a first end portion outward of one of said ends and a second end portion outward of the other of said ends; and means at each of said end portions for releasably attaching the respective end portion to an article wearable by the operator of the vehicle.

2. An article of wear for water activities comprising in combination a life jacket; and a handle for stabilizing a passenger riding on a water vehicle in tandem with an operator wearing said life jacket, said handle including a tubular gripping member having two ends, a pliable covering surrounding said tubular gripping member, an anchoring member extending through said tubular gripping member and having a first end portion outward of one of said ends and a second end portion outward of the other of said ends, and means at each of said end portions for releasably attaching the respective end portion to said life jacket.

3. The article of claim 2, wherein said tubular gripping member is flexible.

4. The article of claim 3, wherein said tubular gripping member comprises soft rubber.

5. The article of claim 2, wherein said covering comprises a foamed elastomeric material.

6. The article of claim 2, wherein said tubular gripping member is provided with a passage having a maximum transverse dimension and said anchoring member has a width greater than said maximum transverse dimension so that said anchoring member frictionally engages said tubular gripping member.

7. The article of claim 2, wherein said anchoring member is removable from said tubular gripping member by moving said anchoring member and said tubular gripping member relative to one another longitudinally of said tubular gripping member.

8. The article of claim 2, wherein said attaching means comprises snaps.

9. The article of claim 2, wherein said tubular gripping member and said covering together constitute a floatable unit.

10. The article of claim 2, wherein said anchoring member comprises a strap.

* * * * *